US007281478B2

(12) United States Patent
Wang et al.

(10) Patent No.: US 7,281,478 B2
(45) Date of Patent: Oct. 16, 2007

(54) ASSEMBLED CATHODE AND PLASMA IGNITER WITH SUCH CATHODE

(75) Inventors: Aisheng Wang, Shandong (CH); Hong Tang, Shandong (CH); Shuxin Ji, Shandong (CH); Yupeng Wang, Shandong (CH); Dong Tian, Shandong (CH); Gonglin Wang, Shandong (CH); Weiwu Ren, Shandong (CH); Xueyuan Chen, Shandong (CH); Ruihu Shao, Shandong (CH); Xiaoyong Zhang, Shandong (CH); Shuang Ma, Shandong (CH)

(73) Assignee: Yan Tai Long Yuan Electric Technology Co., Ltd., Yan Tai, Shandong (CN)

( * ) Notice: Subject to any disclaimer, the term of this patent is extended or adjusted under 35 U.S.C. 154(b) by 413 days.

(21) Appl. No.: 10/469,048

(22) PCT Filed: Feb. 27, 2002

(86) PCT No.: PCT/CN02/00116

§ 371 (c)(1),
(2), (4) Date: Jan. 30, 2004

(87) PCT Pub. No.: WO02/068872

PCT Pub. Date: Sep. 6, 2002

(65) Prior Publication Data

US 2004/0114300 A1 Jun. 17, 2004

(30) Foreign Application Priority Data

Feb. 27, 2001 (CH) ..... 01 2 04455
Feb. 6, 2002 (CH) ..... 02 2 03117

(51) Int. Cl.
*F23D 1/00* (2006.01)
*F23Q 5/00* (2006.01)

(52) U.S. Cl. ..... 110/347; 361/247; 219/121.11; 219/121.36; 219/121.48

(58) Field of Classification Search ..... 361/247; 110/347, 348; 219/121.11, 121.36, 121.48
See application file for complete search history.

(56) References Cited

U.S. PATENT DOCUMENTS 3,130,292 A * 4/1964 Gage et al. ..... 219/75

(Continued)

FOREIGN PATENT DOCUMENTS

CH 88 1 02744 A 11/1988

(Continued)

*Primary Examiner*—Stephen W. Jackson
*Assistant Examiner*—Scott Bauer
(74) *Attorney, Agent, or Firm*—Finnegan, Henderson, Farabow, Garrett & Dunner, L.L.P.

(57) ABSTRACT

This invention relates to a plasma igniter for directly igniting the pulverized coal burner. Said plasma igniter consists of a plasma generator which includes a composite anode, an combined type cathode, an electromagnetic coil and a transmitting coil; a pulverized coal burner which comprises multi-stage chambers for conveying igniting coal, an equipment for adjusting concentration of coal powder and a four-stage burner canister; and a generator brace. Said combined type cathode consists of a cathode plate, a fixation nut, a conductive pipe, an inflowing pipe, an inflowing guiding pipe, a cathode lid and a sealing spacer. The lining for generating electric arc is assembled with the front of cathode. An alloy plate is used as the cathode plate. The nozzle that used for cooling the cathode is first convergent and then expansive, and is placed in the middle of the conductive pipe. The plasma igniter has the advantage of stable burning. It can be used as not only a main burner for the boiler but also an igniting burner. Since oil is not used, lots of petroleum source is saved.

11 Claims, 7 Drawing Sheets

U.S. PATENT DOCUMENTS

| | | | | |
|---|---|---|---|---|
| 4,466,363 | A | 8/1984 | Leikart et al. | |
| 4,788,408 | A * | 11/1988 | Wlodarczyk et al. | 219/121.49 |
| 5,156,100 | A | 10/1992 | Pentii | |
| 5,437,250 | A * | 8/1995 | Rabinovich et al. | 123/3 |
| 6,215,091 | B1 * | 4/2001 | Chung et al. | 219/121.48 |
| 6,789,488 | B2 * | 9/2004 | Levy et al. | 110/348 |

FOREIGN PATENT DOCUMENTS

| | | | |
|---|---|---|---|
| CH | 1031275 | A | 2/1989 |
| CH | 1230656 | A | 10/1999 |
| CH | 99248829.X | | 10/1999 |
| CH | 00245774.1 | | 8/2000 |
| EP | 0 303 522 | A1 | 2/1989 |
| JP | 53-145783 | | 12/1978 |
| JP | 57-037606 | | 3/1982 |
| JP | 4-502531 | | 5/1992 |
| JP | 2001-082705 | | 3/2001 |
| WO | WO92/01194 | | 1/1992 |

* cited by examiner

ASSEMBLED CATHODE AND PLASMA IGNITER WITH SUCH CATHODE

TECHNICAL FIELD

The present invention relates to a cathode of a plasma ignition device for directly igniting a pulverized coal boiler, and a plasma ignition device using such a cathode and for directly starting a pulverized coal boiler. The plasma ignition device is used in the starting ignition stage and the low-load stable combustion stage of the pulverized coal boiler, and may serve as the primary burner of the pulverized coal boiler as well.

BACKGROUND ART

The starting ignition and low-load stable combustion of the conventional industrial pulverized coal boiler rely on burning oil. In the year of 1999, the pulverized coal boilers of the state power system of China consumed about 2.87 million tons of oil, amounting to about 10 billion RMB yuan in value. Since the 1980's, the technologists of different countries focused on developing technologies adopting plasma technology in directly igniting the pulverized coal. An Australian has developed a plasma ignition device, in which the electrodes are protected with nitrogen gas and fat coal is burned. The former Soviet Union has made a large amount of fundamental research and made experiments in power plants in Baoji and Shaoguan in China respectively in 1996 and 1998, but the experiments were not successful. The Tsinghua University and Harerbin Boiler Factory in China have also made a large amount of research.

Various plasma ignition devices for directly igniting pulverized coal developed in different countries failed to achieve progress in some important technical problems such as ensuring the continuous operation of the generator and preventing the burner from coking, thus have not been adopted widely.

A Chinese patent of utility model of the applicant CN no.99248829.x, has disclosed a plasma ignition device used in an axial flow type burner adopting bi-stage powder delivery. However, the burner has some shortcomings. To come extent, coking and ablation will occur. In addition, the coal type that can be burned in the burner is unique and the burner's operation is unstable. For example, the cathode of the burner is a graphite rod, which tends to drop scraps during operation and lead to short circuit and make the voltage unstable.

For overcoming said shortcomings, the applicant filed and was granted a Chinese patent for utility model CN no.00245774.1, entitled as "metal electrode used in plasma ignition device". The electrode disclosed in the patent still has some shortcomings: the anode tends to be damaged during arc starting, the voltage waves greatly, the cathode is short in life and expensive. Therefore, the wide application of the plasma ignition device is influenced adversely.

SUMMARY OF THE INVENTION

Therefore, an object of the invention is to provide a combined type cathode used in plasma ignition device.

Said object is realized by the following cathode. A combined type cathode used in a plasma ignition device, comprises cathode head, tight nuts, electrically conductive tube, water inlet tube, water inlet pipe, water outlet tube, cathode end cap and sealing cushion, said cathode head is welded to the tight nuts of copper, said electrically conductive tube is jointed to the nuts by screwed connection, a water inlet tube is inserted into the other end of the electrically conductive tube, and is jointed thereto by welding or screwed connection, a water outlet tube is mounted by welding in the direction perpendicular to the electrically conductive tube, thereby a cooling system of the cathode is formed, characterized in that on the front end of the cathode is mounted a dedicated arc-starting bush, the cathode plate is made of alloy plate, and a cooling nozzle is adopted. Said cooling nozzle is constructed so that it is first convergent and then divergent.

Under normal operation condition, the inventive combined type cathode has the following properties: self-contracting electric arc, stable voltage, long cycle-life, few burning loss of the anode during arc starting, considerably reduced cost. Therefore, the reliability of the plasma ignition device is improved.

Above object is realized by a plasma ignition device for directly starting a pulverized coal boiler, comprises plasma generator, pulverized coal burner and dc power supply, wherein said plasma generator comprises combined type cathode, composite anode, electromagnetic coil, arc-starting coil mounted surrounding the housing of the composite anode, and linear motor, and said pulverized coal burner comprises burner nozzle, four stages of burning chambers, air-pulverized coal tubes, primary air-pulverized coal tube, guide plates, high-temperature plasma transporting pipe and air-pulverized coal-concentration adjusting guide plate.

According to a preferred embodiment of the invention, said composite anode is in form of double nozzle tubes. Said anode body is made of material having high thermal conductivity and high electrical conductivity and the oxide of which is also electrically conductive, preferably Ag-based alloy, and the anode nozzle may be made of Ag-based alloy or red copper. Said combined type cathode comprises cathode head, arc-starting bush, tight nuts, cathode plate, cooling nozzle, electrically conductive tube, water inlet tube, water inlet pipe, water outlet tube, electrically conductive tube and cathode end cap. Said cathode plate is in shape of a cylinder plus a cone, and is attached to the cathode head through welding, and is made of Ag-based material, the cooling nozzle is constructed so that it is convergent first and then divergent.

Since the combined type cathode adopts high-velocity nozzle with forced cooling, the heat transmission of the cathode is accelerated and the life of the cathode is lengthened. The life of the cathode is further improved through adopting good electrically conductive and good thermally conductive material, preferably Ag-based material as cathode plate.

Through adopting the composite anode, the flow field of the plasma in the inner cavity of the anode is changed. In particular, at the nozzle, the axial component of the flow is dominant, and thus the anode is prevented from being contaminated by the pulverized coal. In addition, since the receiving area of the anode is increased on the basis of the conventional nozzle, the electrons are received within the anode nozzle tube, and thus will not be disturbed by any external dynamic field, and thus the output power of the equipment is very stable. The arc-transporting coil coated outside of the composite anode increases the length of the plasma flame, and thus improve the ability of igniting the pulverized coal.

Furthermore, adopting multi-stage axial powder delivery and gas film cooling techniques, and performing ignition through stage-by-stage amplification, which increase greatly the output power of the burner with lower power consumption, the burner has functions of ignition and stable combustion, as well as serving as primary burner. Specifically, auxiliary air is adopted to perform air film cooling of the first, second, third and fourth burning chambers, so that the wall temperature of the burning chambers is decreased below the ash fusion temperature and coking is prevented. In,the third stage burning chamber, the oxygen is supplemented by the low concentration powder flow; in the fourth burning chamber, the oxygen is supplemented by the auxiliary air, so that the burning is enhanced and the rigidity of the flame is improved.

Therefore, the inventive plasma ignition device has advantages of great power, no coking, high burning efficiency, strong rigidity of flame, and various coals can be burned therein. Since the inventive equipment solves the key techniques relating to the continuous and stable operation of high power plasma ignition device, the inventive plasma ignition device may be widely applied in industrial pulverized coal boiler. The conventional method of starting and igniting industrial boiler and making it stably operating with oil will be replaced, and a large amount of petroleum will be saved.

BRIEF DESCRIPTION OF THE DRAWINGS

The preferred embodiments of the present invention will be discussed in details with reference to the accompanying drawings, in which.

DETAILED DESCRIPTION OF THE INVENTION

Now the preferred embodiment of the present invention will be described in details with reference to the accompanying drawings.

First all the reference signs in the figures will be described in the following table.

| | |
|---|---|
| 101 | pulverized coal burner |
| 102 | plasma generator |
| 103 | bracket |
| 201 | burner nozzle |

-continued

| | |
|---|---|
| 202 | fourth stage burning chamber |
| 203 | burner external cylinder |
| 204 | third stage burning chamber |
| 205 | auxiliary air inner cylinder |
| 206 | second stage burning chamber |
| 207 | powder-air tubes |
| 208 | external cylinder of the first stage burning chamber |
| 209 | auxiliary air inlet tube |
| 210 | primary air guide plate |
| 211 | the flange of the first stage burning chamber |
| 212 | first stage burning chamber |
| 213 | high-temperature plasma transporting pipe |
| 214 | guide plate of the first stage burning chamber |
| 215 | inlet tube of the first stage burning chamber |
| 216 | inlet tube of the second stage burning chamber |
| 217 | primary air-pulverized coal tube |
| 218 | adjustable guide plate for adjusting the powder concentration |
| 219 | guide plate for the second stage burning chamber |
| 220 | powder channel for the third stage burning chamber |
| 221 | link board |
| 222 | auxiliary air channel |
| 223 | auxiliary air channel |
| 301 | cathode head |
| 302 | cathode plate |
| 303 | cooling nozzle |
| 304 | cathode external cylinder |
| 305 | water inlet pipe |
| 306 | cathode end cap |
| 307 | water outlet tube |
| 308 | water supply tube |
| 310 | sealing washer |
| 311 | arc-starting bush |
| 312 | conductor sheet |
| 401 | sealing ring |
| 402 | cathode housing |
| 403 | cavity for cooling water |
| 404 | anode nozzle tube |
| 405 | anode body |
| 406 | anode base |
| 407 | water supply tube |
| 408 | water outlet tube |
| 501 | pulverized coal burner |
| 502 | auxiliary air tube |
| 503 | electromagnetic coil |
| 504 | anode |
| 505 | compressed air inlet tube |
| 506 | cathode |
| 507 | dc power supply |
| 508 | primary air inlet tube |
| 601 | linear induction motor |
| 602 | combined type cathode |
| 603 | electromagnetic coil |
| 604 | composite anode |
| 605 | arc transporting coil |
| 606 | anode water inlet tube |
| 607 | anode water outlet tube |
| 608 | cathode air inlet tube |
| 609 | cathode water outlet tube |
| 610 | cathode water inlet tube |
| 701 | arc-starting coil |
| 703 | compressed air outlet |
| 704 | insulating cylinder |

Figure 3:
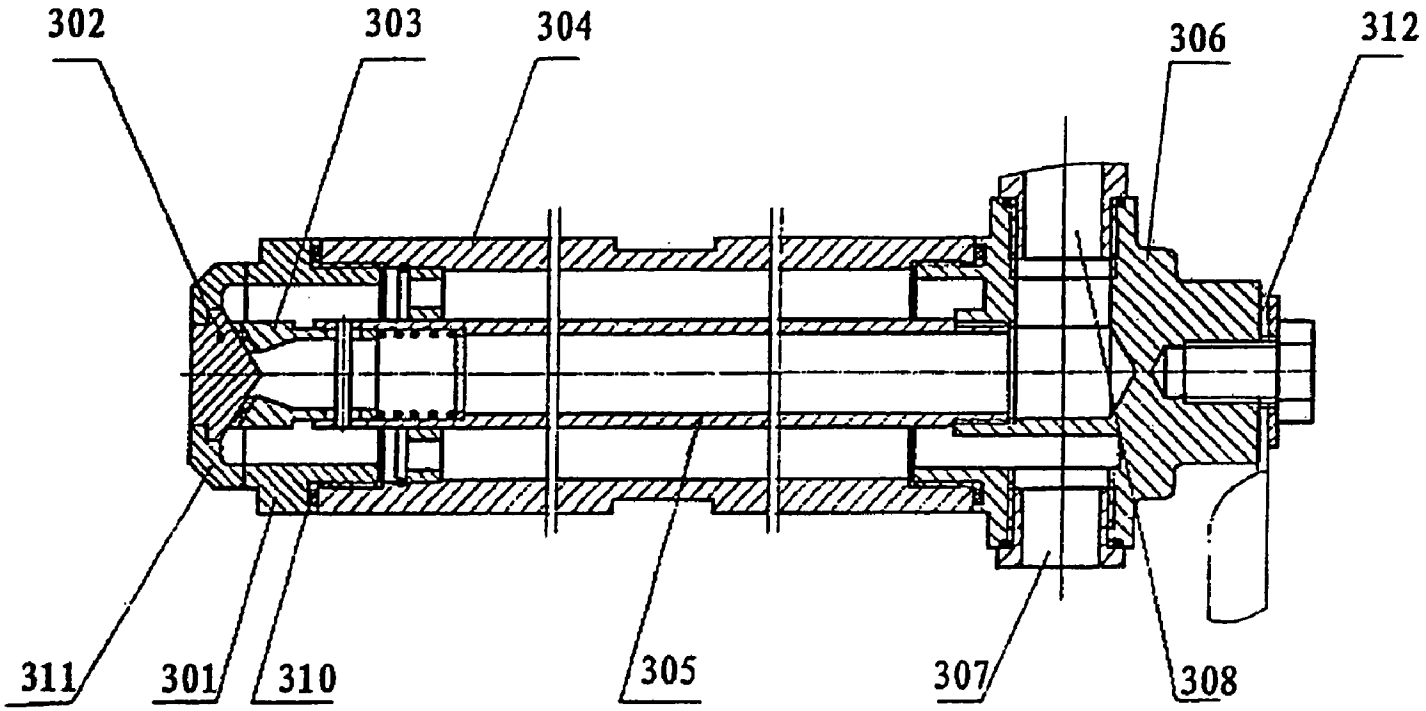
FIG. 3 is a diagram illustrating the structure of a combined type cathode of the plasma ignition device for directly igniting a pulverized coal boiler according to the present invention.

As shown in FIG. 3, a combined type cathode used in a plasma ignition device, comprises cathode head 301, tight nuts, electrically conductive tube 304, water inlet tube 308, water inlet pipe 305, water outlet tube 307, cathode end cap 306 and sealing cushion 310, said cathode head 301 is welded to the tight nuts of copper, said electrically conductive tube 304 is jointed to the nuts by screwed connection, a water inlet tube 308 is inserted into the other end of the electrically conductive tube 304, and is jointed thereto by welding or screwed connection, a water outlet tube 307 is mounted by welding in the direction perpendicular to the electrically conductive tube 304, thereby a cooling system of the cathode is formed, characterized in that on the front end of the cathode is mounted a dedicated arc-starting bush 311, the cathode plate 302 is made of alloy plate, and a cooling nozzle 303 for cooling the cathode plate is jointed to the water inlet tube 308 through welding and is arranged in the center of the electrically conductive tube 304, said cooling nozzle is constructed so that it is first convergent and then divergent.

According to a preferred embodiment, the arc-starting bush 311 is made of graphite rod, which has high fusion temperature and high electrical conductivity, the arc-starting bush 311 is fastened on the front end of the cathode head 301 through screwed connection, and is flush with the cathode plate 302.

According to another preferred embodiment, the cathode plate 302 is made of Ag-based alloy plate, which has high thermal conductivity and high electrical conductivity, the cathode plate 302 is jointed to the cathode head 301 through brazing, and is flush with the arc-starting bush 311. Adopting plate-type cathode enables the self-contracting of the arc starting point.

Figure 7:
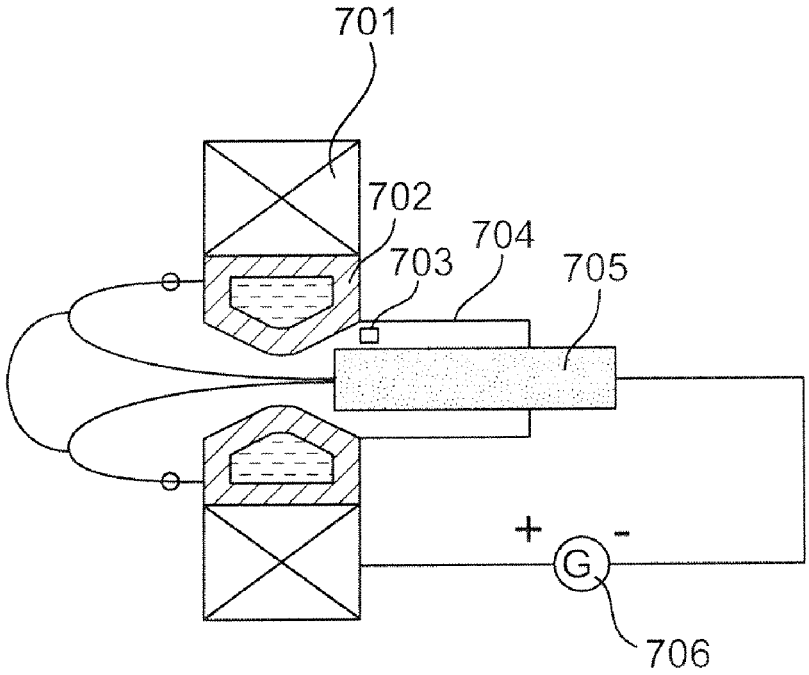
FIG. 7 is a diagram illustrating the operating principle of the plasma generator shown in FIG. 6.

During the operation of the plasma ignition device adopting above combined type cathode, as shown in FIG. 7, when the combined type cathode 705 has been in contact with the anode 702 the dc power supply 706 is powered on and the current load is set. When the combined type cathode 705 departs slowly from the anode 702 an electric arc is first formed between the anode 702 and the arc-starting bush 311. Due to the effects of mechanical compression, magnetic compression and thermal compression, the electric arc is quickly transferred from the arc-starting bush 311 to the central cathode plate 302. The revolving air-flow coming from the compressed air outlet 703 becomes plasma under the action of the energy of the electric arc. Experiments show that the burning loss of the anode during arc starting is much fewer and the life of the node is extended.

In addition, since the cooling nozzle of the cooling system of the cathode adopts a nozzle tube has a structure that is first convergent and then divergent, the liquid is accelerated in the throat portion of the nozzle, so that the efficiency of the heat exchange of the cathode is improved and the life of the cathode is lengthened.

Figure 1:
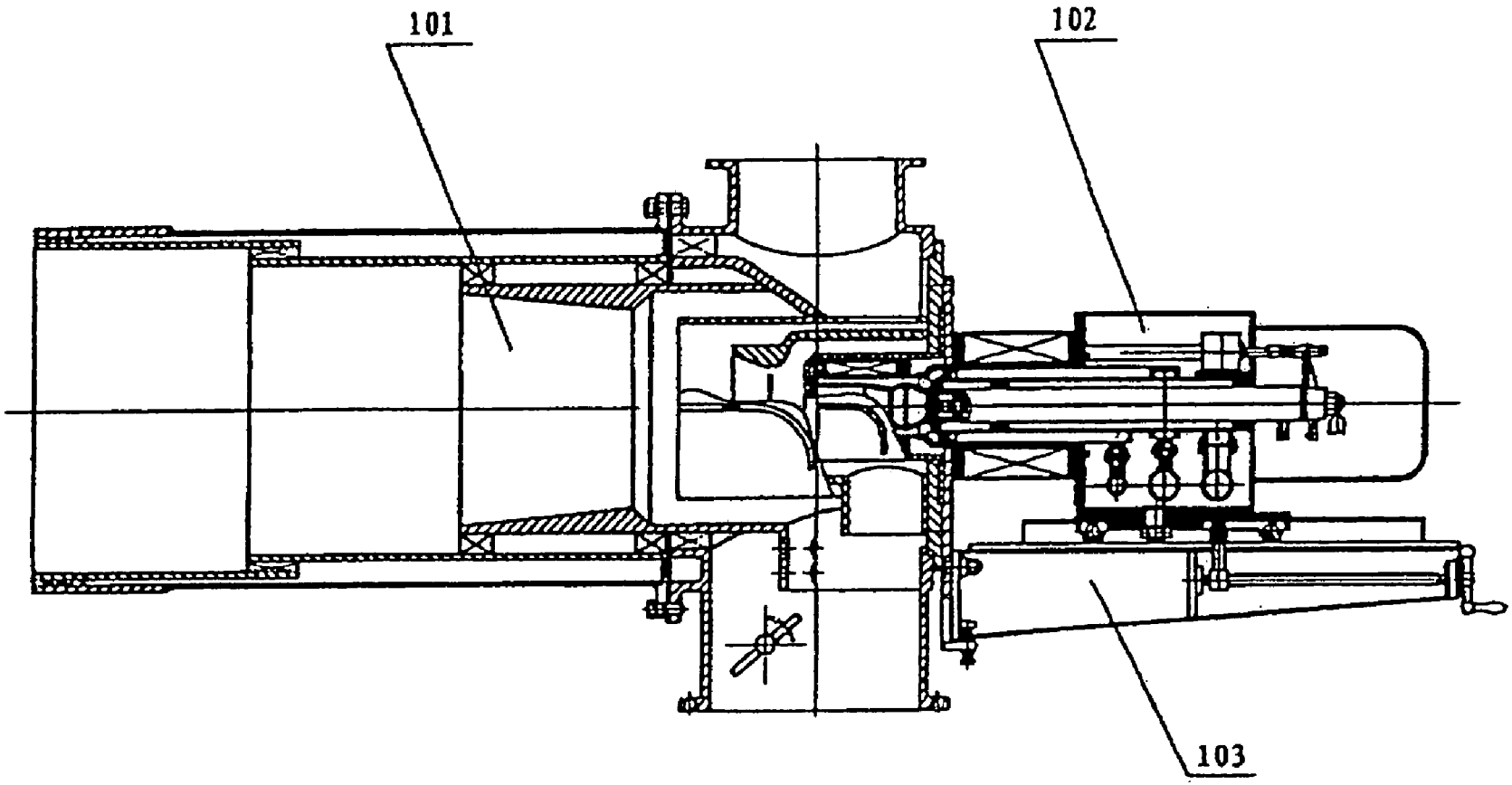
FIG. 1 is a diagram illustrating the structure of a plasma ignition device for directly igniting a pulverized coal boiler according to the present invention.

As shown in FIG. 1, the plasma ignition device for directly igniting a pulverized coal boiler of the invention comprises a plasma generator 102, a pulverized coal burner 101, and a plasma generator bracket 103.

Figure 6:
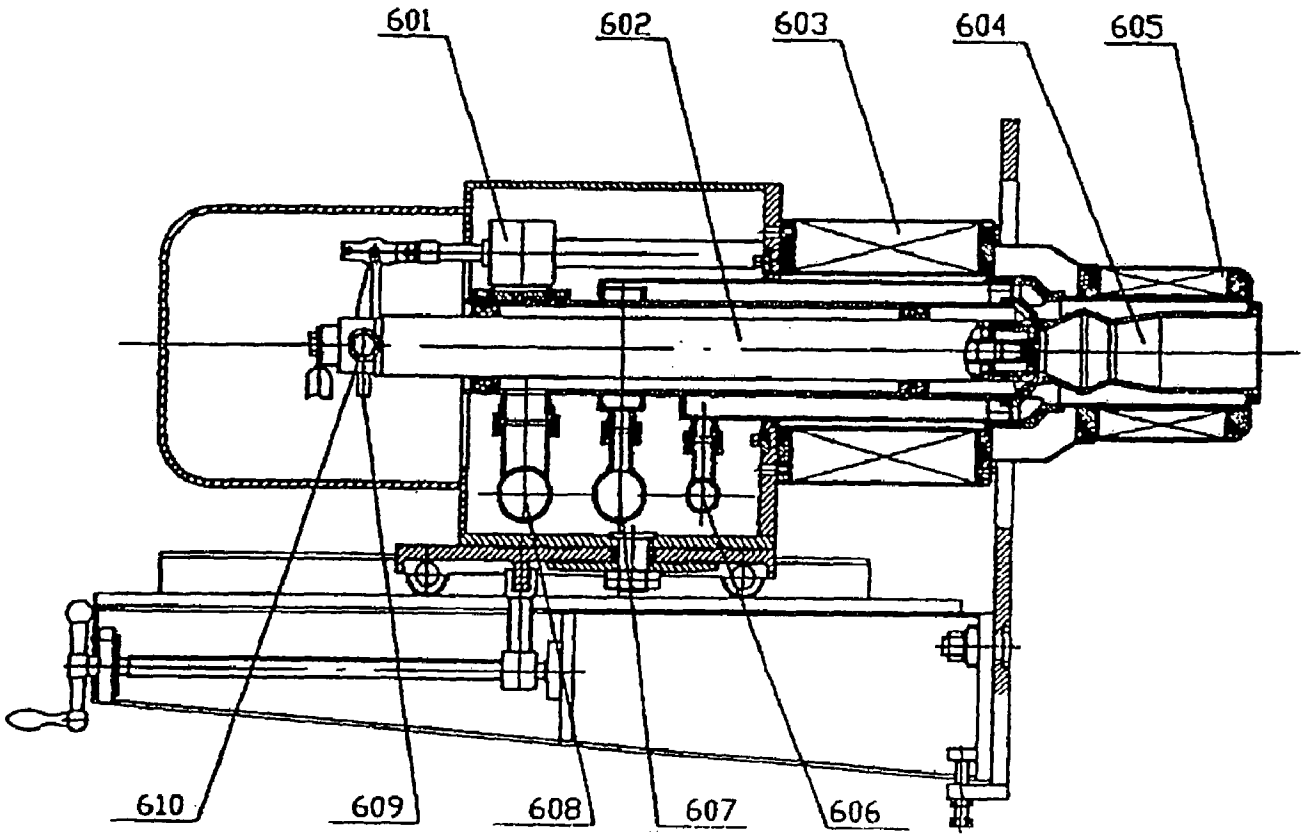
FIG. 6 is a diagram illustrating the structure of a plasma generator of a plasma ignition device for directly igniting a pulverized coal boiler according to the present invention.

Through flange connection, the plasma generator 102 has its composite anode 604 inserted into the first stage burning chamber 212 of the pulverized coal burner. As shown in FIG. 6, said plasma generator comprises composite anode 604, combined type cathode 602, linear motor 601, electromagnetic coil 603 and arc transporting coil 605 mounted surrounding the housing of the composite anode 604. The composite anode 604 and the combined type cathode 602 are arranged in the same axis. The composite anode is connected to the positive pole of the dc power supply 508, and the combined type cathode 602 is connected to the negative pole of the dc power supply 508. The linear motor serves for making said cathode and said anode to contact each other and then pulling them apart from each other so that a plasma electric arc could be established.

Figure 4:
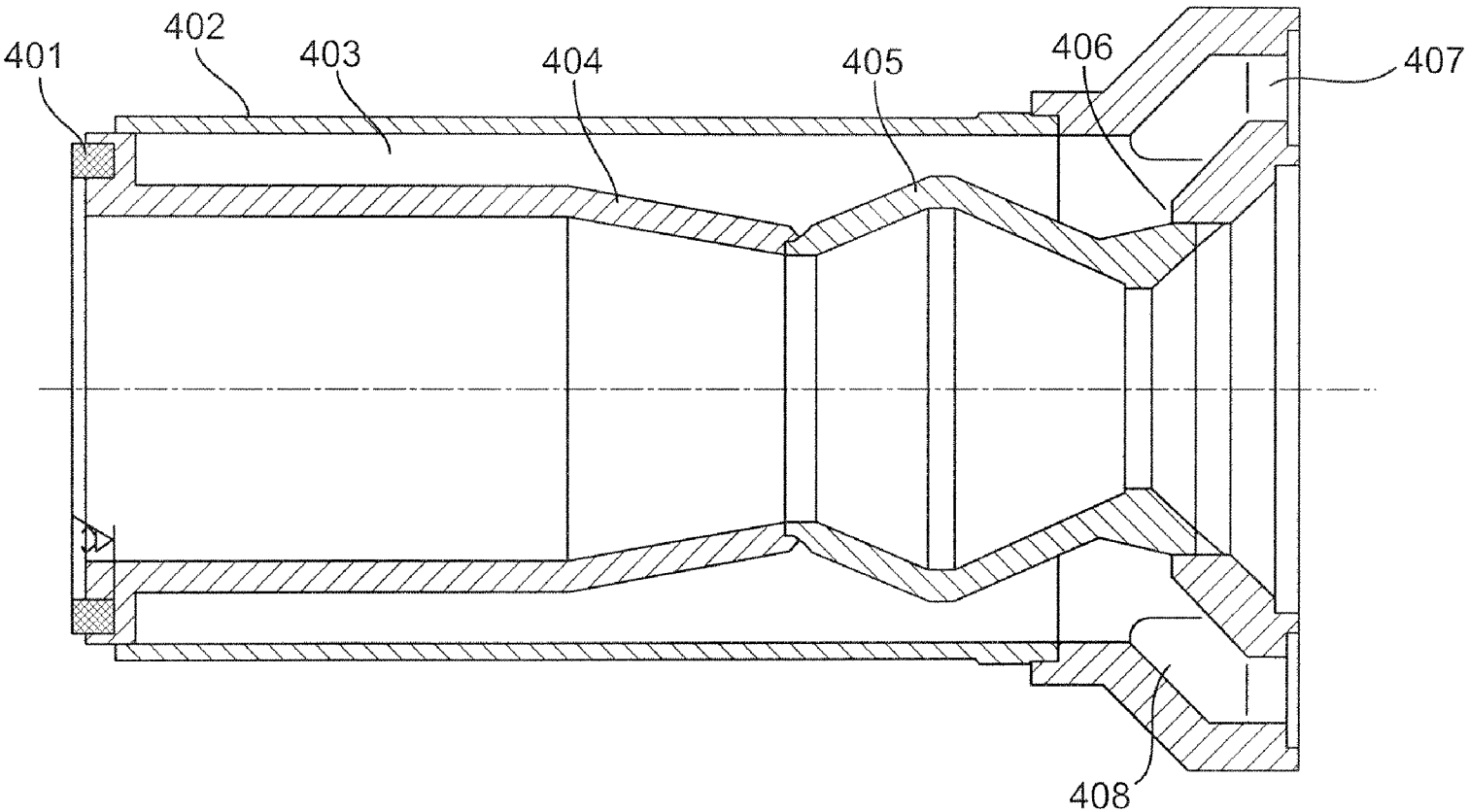
FIG. 4 is a diagram illustrating the structure of a composite anode of the plasma ignition device for directly igniting a pulverized coal boiler according to the present invention.

As shown in FIG. 4, the composite anode is constructed as double nozzle tubes, that is, the composite anode is formed by welding a pair of nozzle tubes. One end of the composite anode is welded to the anode nozzle 404, and the other end is welded to the anode base 406. Said anode body 405 is made of material of high thermal conductivity and high electrical conductivity and the oxide of which is also electrically conductive, such as Ag-based material. The anode nozzle 404 may be made of cu-based or Ag-based material.

As shown in FIG. 3, said combined type cathode comprises cathode head 301, arc-starting bush 311, tight nuts, cathode plate 302, cooling nozzle 303, electrically conductive tube 304, water inlet tube 308, water inlet pipe 305, water outlet tube 307 and cathode end cap 306. The cathode plate 302 is in form of an inversed cone, and is made of Ag-based alloy. The cooling nozzle 303 is constructed so that it is convergent first and then divergent.

Figure 2:
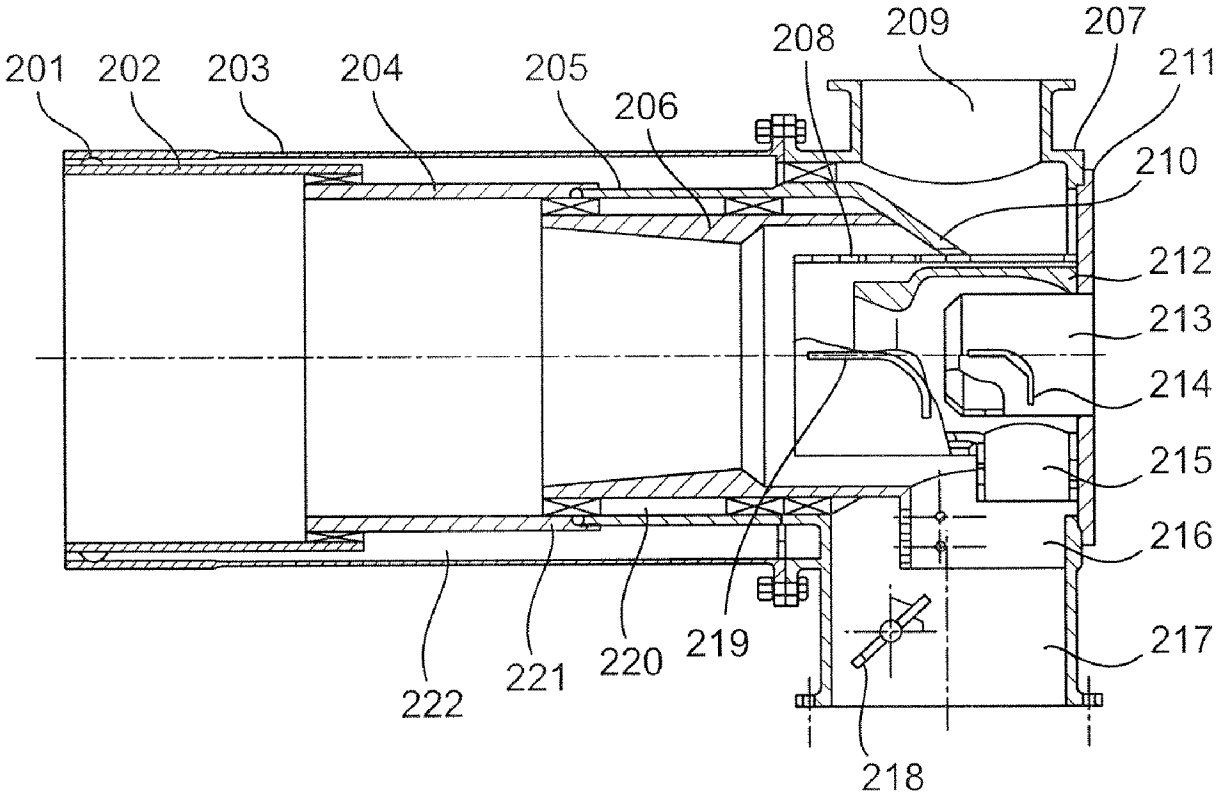
FIG. 2 is a diagram illustrating the structure of a pulverized coal burner of the plasma ignition device for directly igniting a pulverized coal boiler according to the present invention.

As shown in FIG. 2, said pulverized coal burner 101 comprises burner nozzle 201, fourth stage burning chamber 202, third stage burner chamber 204, inlet tube 216 of the second stage burning chamber, primary air-pulverized coal tube 217, auxiliary air inlet tube 209, guide plate 214 of the first stage burning chamber 212, guide plate 219 for the second stage burning chamber and air-pulverized coal channel 220 for the third stage burning chamber. The mixture of the air and the pulverized coal flow coming through the primary air-pulverized coal tube 217 is divided by the pulverized coal-concentration-adjusting guide plate 218 into three streams, which respectively enter into said first three stages of burning chambers and burn therein. The auxiliary air coming through the auxiliary air inlet tube 209 is divided into three streams, which respectively cool and supplement oxygen to the outer wall of the first stage burning chamber 212, the outer wall of the third stage burning chamber 204 and the inner and outer walls of the fourth stage burning chamber 202.

Figure 5:
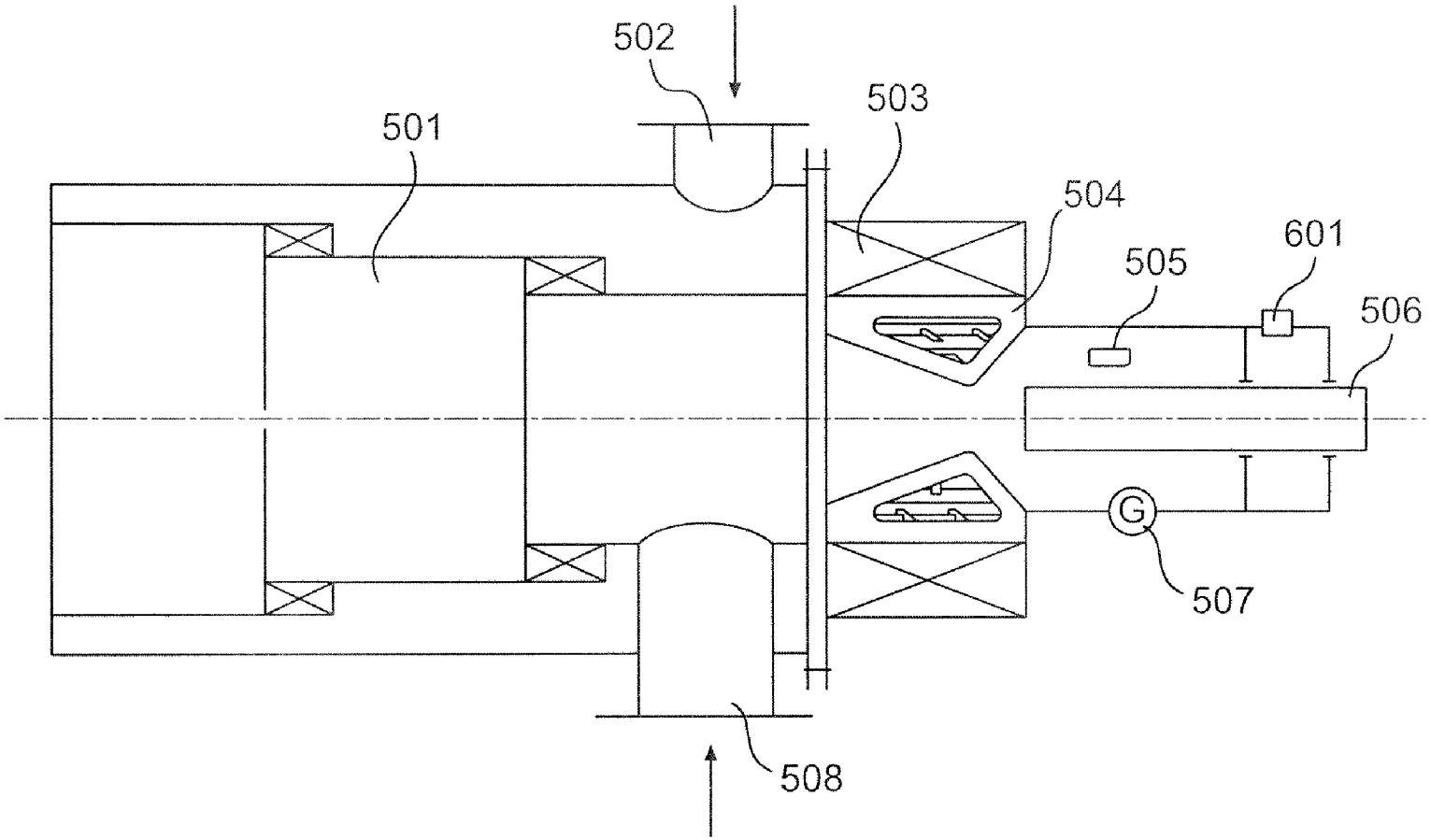
FIG. 5 is a diagram illustrating the operating principle of the plasma ignition device for directly igniting a pulverized coal boiler according to the present invention.

The principle and the operation of the invention will be described below with reference to FIG. 5. When the dc power supply 507 is powered on, the linear motor 601 is started and advances, so that the cathode 506 contacts the anode 504. At the same time, the output current and the air pressure of the compressed air inlet tube 505 are set. With the cathode departing slowly from the anode, an electric arc voltage is established. Since arc voltage is a function of the distance between the two electrodes, the distance shall be determined depending on the type of the coal, so that the power of the arc and the voltage may be determined. The ionized air carrying energy form a plasma flambeau and enters into the first stage burning chamber 212 of the pulverized coal burner, thereby igniting the high concentration pulverized coal passing through the inlet tube 215 of the first stage burning chamber.

At the same time, the pulverized coal introduced by the primary air-pulverized coal tube 217 is divided by the coal-concentration-adjusting guide plate 218 into three streams, which enters into the burner body. A first portion of 20% of the high concentration pulverized coal enters into the first stage burning chamber through the inlet tube 215 of the first stage burning chamber and the guide plate 214 of the first stage burning chamber, and is ignited by said plasma flambeau. The second stream, 60% of the high concentration pulverized coal enters into the second stage burning chamber through the inlet tube 216 of the second stage burning chamber and the guide plate 219 of the second stage burning chamber. The third stream, 20% of the high concentration pulverized coal enters into the third stage burning chamber through the primary air-pulverized coal guide plate 210 and the air-pulverized coal channel 220 for the third stage burning chamber.

Auxiliary air passes through the auxiliary air inlet tube 209 of the air-pulverized coal tube 207 and enters into the burner by two ways. The air of one way passes through the upper inlet of the external cylinder 208 of the first stage burning chamber to cool the outer wall of the first stage burning chamber, and then supplements oxygen for burning. The air of the other way passes through the auxiliary air channel 222 to cool the outer wall of the third stage burning chamber, and then is further divided into two streams, one of which enters into the fourth stage burning chamber to supplement oxygen for burning, the other of which passes through the auxiliary air channel to cool the fourth stage burning chamber, and then enters into the burner hearth.

Thus, when the high-temperature plasma transporting tube provides a high-temperature plasma, as described above, the first portion of 20% of the high concentration pulverized coal is ignited immediately, the flame thereof further ignites the second portion of 60% of the pulverized coal, the rest of the 20% of the pulverized coal passes through the pulverized coal channel of the third stage burning chamber and mixes with above said flambeau and burns. The last portion of the air-pulverized coal flow also serves to cool the second stage burning chamber.

Experiments show that when the amount of pulverized coal in the burning chambers is 500 kg/h, the shape of the flame is Φ700×3000 mm. The flame ignites the pulverized coal in the second stage burning chamber 206 and the third stage burning chamber 204. When the total amount of the pulverized coal is 5000 kg/h, the temperature of the flame is greater than 1200° C., the jetting velocity at the nozzle is about 45-55 m/s, and the shape of the flame is approximately Φ1000×7000 mm. When adopting four plasma ignition devices in straight-flow burner, tangential firing may be maintained, thus starting ignition and stable combustion may be realized.

The invention claimed is:

1. A plasma ignition device for directly igniting a pulverized coal boiler, comprising a plasma generator, a pulverized coal burner, and a dc power supply for supplying electric power to the plasma generator, wherein said plasma generator comprises a cathode, an anode, an electromagnetic coil disposed around a space between the cathode and the anode when the cathode is moved away from the anode, and a linear motor for driving the cathode back and forth to contact the anode or move away from the anode, and wherein said pulverized coal burner comprises an external cylinder, at least two stages of burning chambers arranged in the external cylinder and cascaded one after another, inlet tubes respectively for said at least two stages of burning chambers, a primary air-pulverized coal tube for supplying an air-pulverized coal mixture of air and pulverized coal to said inlet tubes of said at least two stages of burning chambers, an auxiliary air inlet tube for supplying auxiliary air into the external cylinder, and a burner nozzle in an end of a last stage burning chamber, wherein the plasma generated by an arc discharging between the cathode and the anode will ignite the air-pulverized coal mixture in a first stage burning chamber, which further ignites the air-pulverized coal mixture in the next stage burning chamber, and wherein the auxiliary air or air-pulverized coal mixture flowing between walls of the respective stages of the burning chambers or between the external cylinder and outside walls of the respective stages of the burning chambers cools the walls of the respective stages of the burning chambers.

2. The plasma ignition device according to claim 1, wherein said cathode is a combined cathode comprising a cathode head, an arc-starting bush mounted on the cathode head, a cathode plate surrounded by the arc-starting bush, a cooling nozzle for cooling the cathode plate with water, an electrically conductive tube connected at one end to the arc-starting bush, a water supply inlet tube for supplying said water located at an opposite end of the electrically conductive tube, a water inlet pipe in said electrically conductive tube for supplying said water from said water supply inlet tube to said cooling nozzle, a water outlet tube for discharging said water mounted to the electrically conductive tube, and a cathode end cap at said opposite end of the electrically conductive tube.

3. The plasma ignition device according to claim 2, wherein said cathode plate is in the shape of a cylinder plus a cone, and is attached to the cathode head through welding, and is made of an Ag-based material, which is a highly electrically conductive and a highly thermally conductive medal, and an oxide of which is also conductive, the cooling nozzle being constructed so that it is convergent first and then divergent.

4. The plasma ignition device according to claim 1, wherein said anode is a composite anode comprising an anode housing, an anode nozzle, an anode body, an anode base, a water supply tube and a water outlet tube, wherein one end of said anode housing is welded to the anode nozzle, and an other end is welded to the anode base, and wherein the anode nozzle, the anode body and the anode base are integral, and both the water supply tube and the water outlet tube are communicated with a cavity of cooling water defined between an inner wall of the anode housing and an outer wall of the anode nozzle, the anode body, and the anode base.

5. The plasma ignition device according to claim 4, wherein said anode body is made of an Ag-based alloy, and the anode nozzle is made of copper or an Ag-based alloy.

6. The plasma ignition device according to claim 4 or 5, wherein said composite anode is surrounded by an arc transporting coil.

7. The plasma ignition device according to claim 1, wherein said at least two stages of burning chambers comprise a first stage burning chamber, a second stage burning chamber, a third stage burning chamber, and a fourth stage burning chamber, and the pulverized coal burner further comprises a primary air-pulverized coal guide plate, and a pulverized coal-concentration-adjusting guide plate, wherein the air-pulverized coal mixture flowing through the primary air-pulverized coal tube is divided into three streams, which respectively pass through a guide plate for the first stage burning chamber, a guide plate for the second stage burning chamber and the primary air-pulverized coal guide plate, respectively into the first stage burning chamber, the second stage burning chamber, and the third stage burning chamber, the auxiliary air coming from the auxiliary air inlet tube being divided into three streams, which respectively cools an external wall of the first stage burning chamber, an external wall of the third stage burning chamber, and an external wall of the fourth stage burning chamber, a portion of the auxiliary air entering into an inner wall of the fourth stage burning chamber and the outer wall of the first stage burning chamber so as to supplement oxygen for facilitating combustion, the air-pulverized coal mixture in the first stage burning chamber being changed by the guide plate for the first stage burning chamber from radial flow into axial flow, and the pulverized coal-concentration-adjusting guide plate adjusting the concentration of the pulverized coal to a concentration facilitating ignition.

8. A combined type cathode, comprising a cathode head, an arc-starting bush mounted on the cathode head, a cathode plate surrounded by the arc-starting bush, a cooling nozzle for cooling the cathode plate with water, an electrically conductive tube connected at one end to the arc-starting bush, a water supply inlet tube for supplying said water located at an opposite end of the electrically conductive tube, a water inlet pipe in said electrically conductive tube for supplying said water from said water supply inlet tube to said cooling nozzle, a water outlet tube for discharging said water mounted to the electrically conductive tube, and a cathode end cap at said opposite end of the electrically conductive tube.

9. The combined type cathode according to claim 8, wherein the arc-starting bush is made of a graphite rod, which has a high fusion temperature and a high electrical conductivity, the arc-starting bush being fastened on a front end of the cathode head through a screwed connection, and being flush with the cathode plate.

10. The combined type cathode according to claim 8 or 9, wherein the cathode plate is joined to the cathode head through brazing, and a surface thereof is flush with the arc-starting bush.

11. The combined type cathode according to claim 8, wherein said cathode plate is in the shape of a cylinder plus a cone, and is attached to the cathode head through welding, and is made of an Ag-based material, which is a highly electrically conductive and a highly thermally conductive material, and an oxide of which is also conductive, the cooling nozzle being constructed so that it is convergent first and then divergent.

* * * * *

UNITED STATES PATENT AND TRADEMARK OFFICE

CERTIFICATE OF CORRECTION

PATENT NO. : 7,281,478 B2
APPLICATION NO. : 10/469048
DATED : October 16, 2007
INVENTOR(S) : Aisheng Wang et al.

It is certified that error appears in the above-identified patent and that said Letters Patent is hereby corrected as shown below:

Title page, Item (57), delete the Abstract in its entirety and insert therefor:

--A plasma igniter for directly igniting a pulverized coal boiler. The plasma igniter includes a plasma generator having a composite anode, a combined type cathode, an electromagnetic coil and a transmitting coil; a pulverized coal burner which includes multi-stage chambers for conveying igniting coal, an equipment for adjusting concentration of pulverized coal and a four-stage burner canister; and a generator brace. The combined type cathode includes a cathode plate, a fixation nut, a conductive pipe, an inflowing pipe, an inflowing guiding pipe, a cathode lid and a sealing spacer. The lining for generating an electric arc is assembled with the front of the cathode. An alloy plate is used as the cathode plate. A nozzle used for cooling the cathode is first convergent and then expansive, and is placed in the middle of the conductive pipe. The plasma igniter has the advantage of stable burning. It can be used as not only a main burner for the boiler but also an igniting burner.--

Signed and Sealed this

Twenty-fourth Day of June, 2008

JON W. DUDAS
*Director of the United States Patent and Trademark Office*